United States Patent [19]

Takaniemi

[11] Patent Number: 4,827,816

[45] Date of Patent: May 9, 1989

[54] CUTTING APPARATUS

[75] Inventor: Tauno Takaniemi, Tampere, Finland

[73] Assignee: Vendmatic Oy, Nokia, Finland

[21] Appl. No.: 107,834

[22] PCT Filed: Feb. 10, 1987

[86] PCT No.: PCT/FI87/00021

§ 371 Date: Oct. 6, 1987

§ 102(e) Date: Oct. 6, 1987

[87] PCT Pub. No.: WO87/04655

PCT Pub. Date: Aug. 13, 1987

[30] Foreign Application Priority Data

Feb. 11, 1986 [FI] Finland ..... 860629

[51] Int. Cl.[4] ..... B26D 3/16

[52] U.S. Cl. ..... 82/70.1; 82/83; 82/97; 82/101; 83/54

[58] Field of Search ..... 82/101, 102, 83, 94, 82/95, 96, 97, 92, 70.1; 83/54

[56] References Cited

U.S. PATENT DOCUMENTS

| | | | |
|---|---|---|---|
| 1,215,121 | 2/1917 | Cramer | 30/94 |
| 1,322,007 | 11/1919 | Golding | 30/94 |
| 2,701,015 | 2/1955 | Gottschalk | 82/101 |
| 3,315,355 | 4/1967 | Osburn . | |
| 3,919,904 | 11/1975 | Kuts | 82/101 |
| 4,205,866 | 6/1980 | Molnar | 82/102 |
| 4,307,512 | 12/1981 | Phillips | 30/94 |

FOREIGN PATENT DOCUMENTS

| | | | |
|---|---|---|---|
| 0168334 | 6/1985 | European Pat. Off. . | |
| 2315132 | 10/1974 | Fed. Rep. of Germany . | |
| 2843372 | 4/1980 | Fed. Rep. of Germany . | |
| 3347705 | 3/1985 | Fed. Rep. of Germany . | |
| 3407854 | 9/1985 | Fed. Rep. of Germany | 82/97 |
| 2101665 | 3/1972 | France . | |
| 2333412 | 11/1975 | France . | |
| 81/00821 | 4/1981 | PCT Int'l Appl. . | |
| 421499 | 6/1981 | Sweden . | |
| 555719 | 12/1972 | Switzerland . | |
| 1128691 | 10/1968 | United Kingdom . | |
| 1519730 | 8/1978 | United Kingdom . | |

*Primary Examiner*—Frederick R. Schmidt
*Assistant Examiner*—Blynn Shideler
*Attorney, Agent, or Firm*—Pollock, Vande Sande & Priddy

[57] ABSTRACT

Tube cutting apparatus comprises means (4) supporting the tube (3, 11) during the cutting operation and at the same time allowing the rotatory movement of the tube about its longitudinal axis, a shaft (28), wherein a cutting blade (38) and a means (36) for rotating the tube are disposed concentrically and means (27, 31) for moving the shaft (28) in direction substantially perpendicular to the longitudinal axis of the tube (3, 11) to be cut and for rotating the shaft (28) about its longitudinal axis. The means (36) for rotating the tube is of a greater diameter than the cutting blade.

1 Claim, 2 Drawing Sheets

CUTTING APPARATUS

BACKGROUND OF THE INVENTION

The present invention relates to a cutting apparatus, the especially a tube cutting apparatus.

The publication No. SE-421 499 discloses a cutting apparatus having a cutting blade and means for rotating the tube to be cut during the cutting operation. The cutting blade and the means for rotating the tube are disposed separately from each other and each of them has its own driving mechanism. The cutting blade is arranged to be moved pivotally in a direction perpendicular to the longitudinal axis of the tube during the cutting operation. The constructions of such prior art apparatus is deficient as far as the function and construction is concerned.

SUMMARY OF THE PRESENT INVENTION

The object of this invention is to provide a cutting apparatus, by means of which a simple and functionally reliable cutting is possible. The cutting apparatus will be particularly suitable for rigid tubes, of which cores or barrels made of board can be mentioned as an example.

The according to present invention apparatus comprises means, which support the tube during the cutting operation and at the same time enable the rotatory movement of the tube about its longitudinal axis. The apparatus further comprises a cutting blade and means for rotating the tube, which both are disposed substantially concentrically onto a common shaft. Connected with this shaft, there are both means for rotating the shaft about its longitudinal axis and means for moving the shaft in a direction perpendicular to the longitudinal axis of the tube to be cut.

The means for rotating the tube has a greater diameter than the cutting blade and it has a certain elasticity in a direction perpendicular to the shaft. In this case the means for rotating the tube reaches first the surface of the tube during the first stage of the cutting operation and the tube starts to rotate about its longitudinal axis with a peripheral speed equal to that of the for rotating means. The rotatory movement of the shaft is thus transmitted to the tube, which starts to rotate supported by its support means. When the movement of the shaft towards the longitudinal axis of the tube to be cut is continued, the rotating means, due to the elasticity in the radial direction allows the cutting blade to start to effect on the cutting point of the tube by the cutting edge while the tube continues to rotate about its longitudinal axis. This is possible because the contact between the outer surface of the tube to be cut and the elastic means mounted on the shaft is maintained. After the blade has carried out the cutting operation, the shaft is moved away from the center axis of the tube and at the same time the member rotating the tube is expanding in its radial direction to its original dimensions. The means quarantees in the final stage of this movement, that the blade will be detached from the cutting point, because this elastic means is the last to be in contact with the outer surface of the tube after the cutting has been done. In a summary, the rotatory movement of the tube about its longitudinal axis, the rotatory movement of the cutting blade, the feed movement during the cutting and a reliable return movement after the cutting, are all achieved by means of a simple construction.

According to a preferred embodiment of the present invention, the elastic member for rotating the tube is an inflatable tire placed round the center wheel, which is fixed to the shaft. This makes the realization of the invention possible in a constructionally simple and reliable way.

The present invention will be described in more detail in the following description with reference to the accompanying drawings. In the drawings

DETAILED DESCRIPTION OF THE PREFERRED EMBODIMENTS

Figure 1:
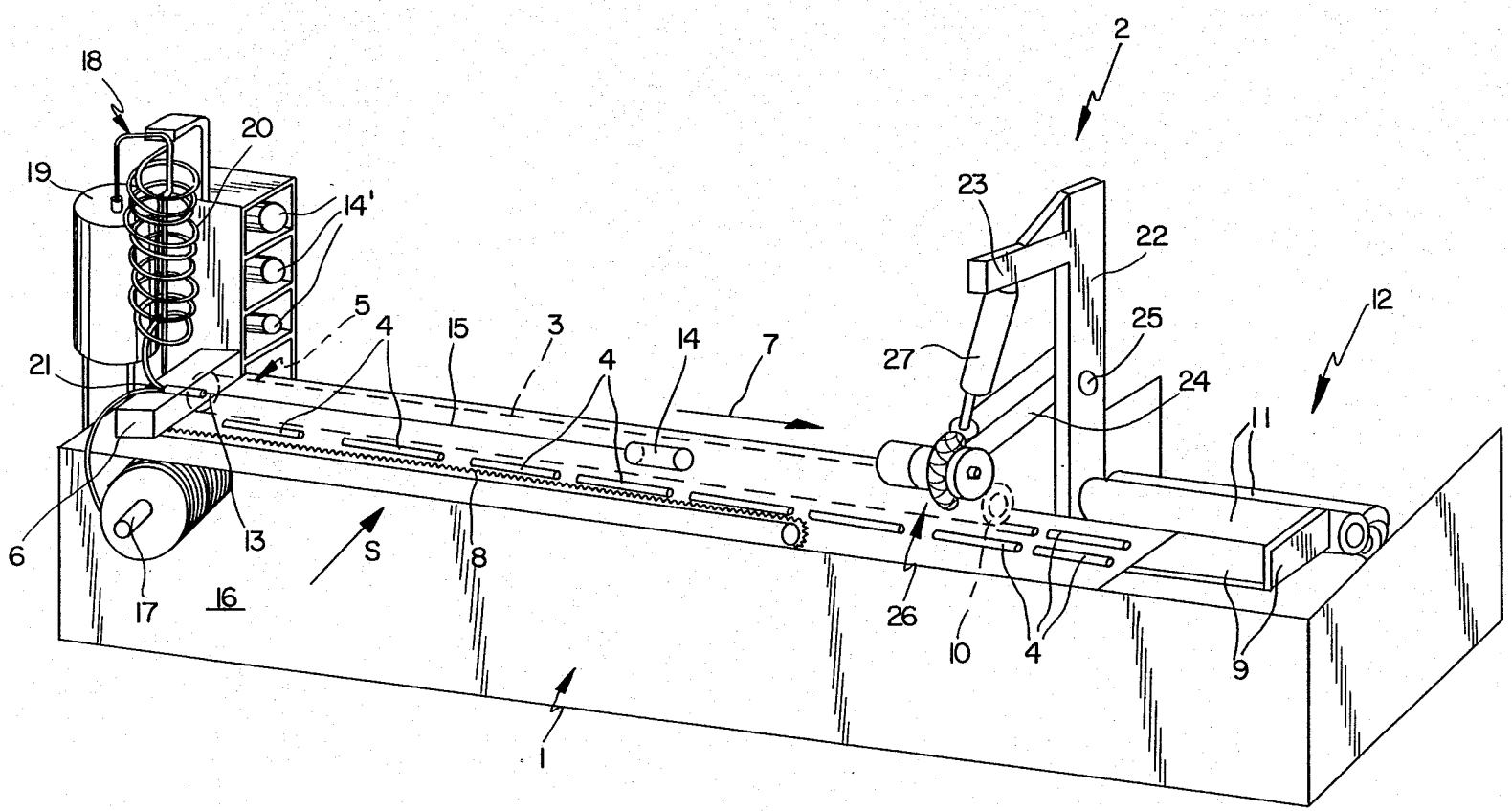
FIG. 1 is a perspective view of the apparatus using the cutting device according to the invention and FIG. 2 is a partial sectional view of the cutting device seen in a direction perpendicular to the longitudinal axes of the shaft and the tube to be cut.

The apparatus illustrated in FIG. 1 comprises an elongate body member 1, which is shown partially cut and in which the cutting assembly for cutting the tubular blank 3 (represented by broken lines) is mounted. The body construction 1 comprises vertical rollers 4 acting as means for supporting the tubular blank 3 to be cut. The rollers are aligned one after the other in the longitudinal direction of the tubular blank 3 and are arranged at the both sides of the tubular blank so tht the rollers can rotate about their longitudinal axes parallel to the longitudinal axis of the tubular blank 3. The tubular blank to be cut rests on these rollers. The tubular blank 3 to be cut is fed towards the cutting assembly 2 sucessively in accordance with the length of the pieces to be severed off the tubular blank. The feeding operation is carried out by the feed assembly 5 for the tubular blank and it comprises a pusher head 6, which is arranged to be moved in the direction of the feed shown by arrow 7, for example by means of a belt drive 8 shown in the figure and the pusher head 6 is guided by rails (not shown). The feed assembly comprises further a back stop 9 adjustable in the longitudinal direction of the tubular blank and contacting the front end 10 of the tubular blank 3 after each feeding movement of the pusher head 6 in the feed direction 7. The back stop 9 is coupled to the drive motor of the belt 8 of the pusher head 6 and the motor will stop as the front end 10 of the tubular blank 3 contacts the back stop 9.

The apparatus further comprises an intermediate storage 12 for the severed tubular pieces 11. The pieces 11 are transferred from the body member 1 for example by means of a pusher (not shown in the drawings) before a new feeding movement of the tubular blank. In the construction shown by FIG. 1, the pusher head 6 abuts the rear end 13 of the tubular blank 3. It is clear, that the feed assembly 5, as far as the pusher head 6 is concerned, can be constructionally realized also in various other ways.

FIG. 1 shows further an assembly for bringing the stopping piece 14 used in the cutting operation to the cutting point as well as for holding the stopping piece at the cutting point. The stopping piece 14 is a formed piece having a cross section, which corresponds substantially to the cross section of the core hole of the tubular blank 3 to be cut. The stopping piece 14 has usually the shape of a cylinder and its front end in the feed direction is preferably rounded. A flexible elongate member 15, such as a wire rope, a chain or the like is fixed to its rear end in feed direction. The flexible member 15 is connected with a collecting member 16, such as a reel, which is arranged to rotate about a horizontal shaft 17 mounted in the body construction 1. The flexible member 15 is wound and unwound on its outer periphery.

The flexible 15 member can be a wire rope or the like. The force needed for the transfer is obtained by blowing air with a air compressing device 18 in to the tubular blank to be cut. The device comprises a tank 19 and a hose 20 for the compressed air as well as a hole 21 going through the pusher head 6 and in connection with the core hole of the tubular blank 3 to be cut. By means of the compressed air, a force directed onto the rear surface of the stopping piece 14 is obtained and the stopping piece 14 moves under this influence from the rear end 13 of the tubular blank 3 to the cutting point and at the same time the flexible member unwinds from the collecting member 16, whose rotation about its shaft 17 is so restricted, that the stopping piece 14 stops at the cutting point held by the flexible member. The flexible member extends through the pusher head 6 for example through the hole 21 or through a separate hole (not shown in FIG. 1). The abutting surface of the pusher head 6 is dimensioned at the rear end 13 of the tubular blank 3 so, that it covers the core hole of the tubular blank thus increasing the effect of the compressed air on the stopping piece.

The stopping piece 14 can be brought to the cutting point also by merely pushing with a chain. There are commercially availble chains, by means of which pushing forces directed to the chain can be transmitted at least to a certain extent. As the outer surface of the stopping piece is formed so that its frictional characteristics will be adapted to the characteristics of the inner surface of the tubular blank to obtain a minimum friction between the inner surface of the tubular blank 3 and the outer surface of the stopping piece 14, the chain is not subjected to any greater bearing stress.

FIG. 1 shows further the storage for stopping pieces on the right side of the compressed air device 18.

The storage contains various stopping pieces 14', whose dimensions fit with the tubes of different sizes. A new tubular blank can be fed onto the rollers 4 of the apparatus in the direction of arrow S.

The stopping piece 14 as well as assemblies associated therewith are described in more detail in a co-pending FI-patent application 860630 by the same applicant, relating to a tube cutting apparatus.

The cutting assembly 2 comprises an upright beam 22 fixed on the body member 1 and bearing at its upper portion a horizontal beam 23 directed towards the body member 1. Underneath the horizontal beam 23, a moving beam 24 is pivotally fixed to the upright beam 22 at a point of articulation 25, and it is pivotable in a vertical plane. The pivotal movement and at the same time the feed movement of the cutting device 26 towards the central axis of the tubular blank 3 is effected by an operational device 27, such as a pneumatic cylinder, which is disposed between the horizontal beam 23 and the moving beam 24.

Figure 2:
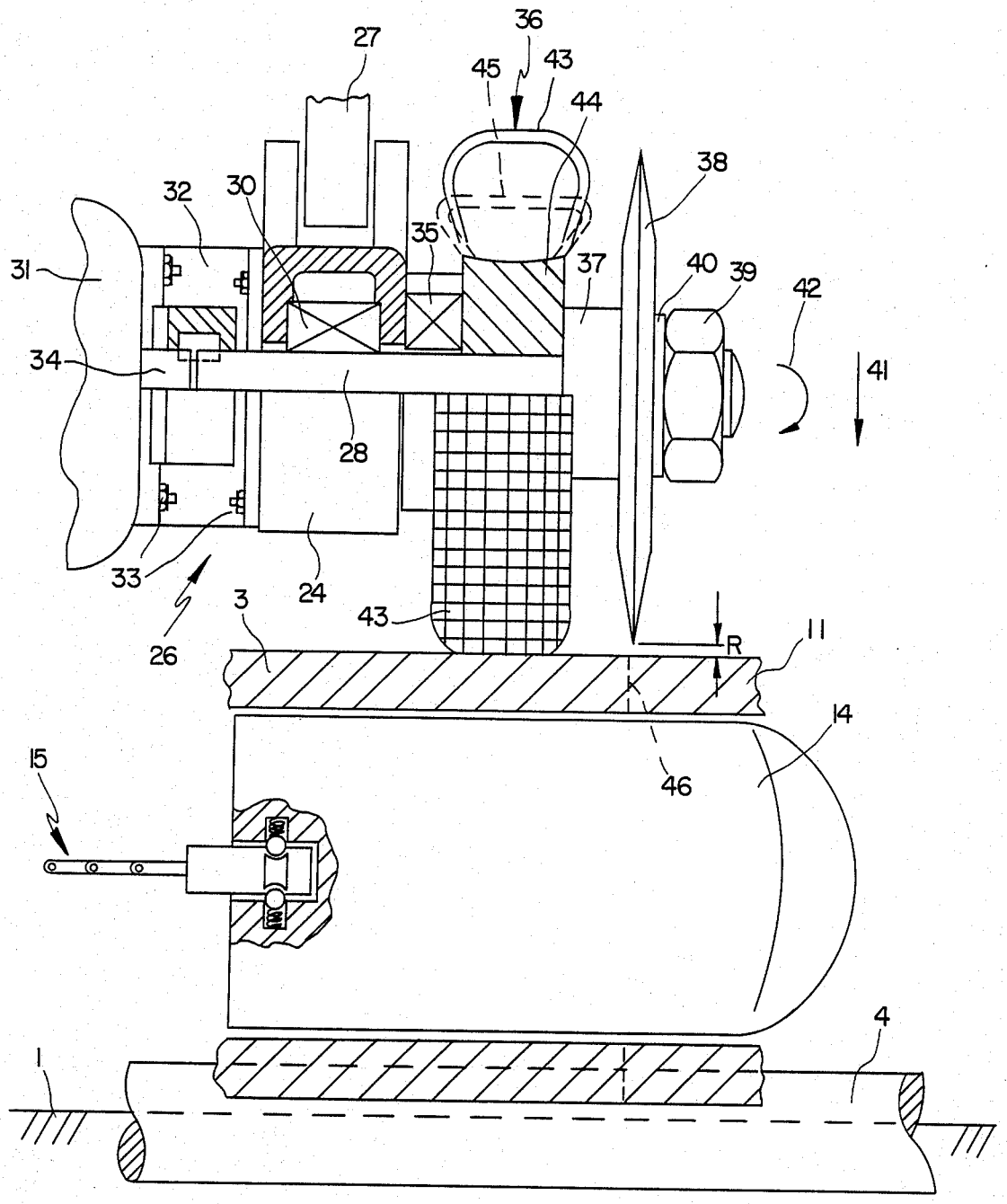

FIG. 2 shows the structure the cutting device 26 in more detail as a partially sectional view seeing in a direction perpendicular to the longitudinal directions of the shaft 28 and the central axis of the tubular blank 3. The shaft 28 is rotatably mounted in the moving beam 24 by means of a bearing 30. The drive motor 31 of the shaft 28 is secured to the moving beam 24 with fixing means 32, 33. The drive shaft 34 of the motor 31 can be coupled to the shaft 28 with any previously known clutch means. On the opposite side of the moving beam 24 remote from the drive motor 31, a bearing 35 is disposed allowing the means 36 to rotate relative to the side surface of the moving beam 24. The means 36 is separated from the cutting blade 38 with the aid of a intermediate bushing 37 and the parts 36, 37 and 38 are secured on the shaft 28 by a fixing nut 39, which through a base plate 40 effects on the parts pressing these to a combination acting as an integral unit.

The cutting assembly can be naturally realized constructionally in many various ways. An essential feature of this kind of construction is, that the cutting assembly can be transferred as an integral unit towards the tubular blank 3 as shown by arrow 41 and at the same time the assembly constituted of the means 36 and the cutting blade 38 can be rotated about the shaft 28 as shown by arrow 42.

The means 36 can be for example an inflatable rubber tire 43 placed round the center wheel 44 on the shaft 28. The air space within the tire makes the compression of the tire possible as the shaft 28 is fed in the direction of arrow 41. The shape of the cross section of the tire at the end stage of the cutting operation is represented by broken lines 45. The cutting blade 38 has preferably a circular and disc-like shape and its cutting edge is located on its outer periphery. The diameter of the cutting blade is smaller than the outer diameter of the means 36 as the 36 means is in its rest position free of contact with the outer surface of the tubular blank 3. Due to this feature, a distance R shown in FIG. 2 exists, because the means 36 and the cutting blade 38 are fixed concentrically on the shaft 28 and this distance makes the above described function during the cutting operation possible. The cutting point is represented in FIG. 2 by a broken line 46.

It is clear, that the cutting device can be provided also in apparatuses different from that presented in the above description. Also the cutting assembly 2 and the construction of the cutting device 26 must be regarded as one of the various possibilities within the scope of the invention.

I claim:

1. A cutting apparatus, especially a tube cutting apparatus comprising:

a shaft;

a cutting blade mounted on said shaft;

a circular means for rotating the tube to be cut about its longitudinal axis, said circular means being mounted on said shaft co-axially with said cutting blade and at a distance therefrom;

said circular means for rotating the tube having a greater diameter than said cutting blade, said circular means being arranged to be elastic in the radial direction;

said circular means for rotating the tube comprising an inflatable tire placed round a center wheel which is fixed to said shaft;

means for moving said cutting blade in a direction substantially perpendicular to the longitudinal axis of the tube and for rotating said cutting blade; and means for supporting the tube during the cutting operation and at the same time allowing the rotatory movement of the tube about its longitudinal axis.

* * * * *